United States Patent [19]

Takayanagi et al.

[11] 4,138,835

[45] Feb. 13, 1979

[54] METHOD AND APPARATUS FOR PREPARING A CASING LOADED WITH A PLURALITY OF ARTICLES

[75] Inventors: Takeo Takayanagi, Nara; Mamoru Inoue, Katano; Satoshi Kuwano, Kawanishi; Hitoshi Minabe; Shunichi Yabuzaki, both of Neyagawa, all of Japan

[73] Assignee: Matsushita Electric Industrial Co., Ltd., Osaka, Japan

[21] Appl. No.: 823,116

[22] Filed: Aug. 9, 1977

[30] Foreign Application Priority Data

Aug. 16, 1976 [JP] Japan ..... 51-98014

[51] Int. Cl.[2] ..... B65B 5/10; B65B 35/00

[52] U.S. Cl. ..... 53/474; 53/155; 53/238; 53/240; 53/244; 53/254; 53/536

[58] Field of Search ..... 53/35, 154, 155, 163, 53/212, 237, 238, 240, 244, 245, 254

[56] References Cited

U.S. PATENT DOCUMENTS

| | | | |
|---|---|---|---|
| 1,399,586 | 12/1921 | Simmons | 53/254 |
| 1,431,399 | 10/1922 | Hill | 53/244 |
| 3,015,917 | 1/1962 | Moore | 53/35 X |
| 3,346,784 | 10/1967 | Blake | 53/254 X |
| 3,930,351 | 1/1976 | Ueda et al. | 53/35 |

*Primary Examiner*—Robert Louis Spruill
*Attorney, Agent, or Firm*—Stevens, Davis, Miller & Mosher

[57] ABSTRACT

A method and apparatus for preparing a casing loaded with a plurality of articles such as small-sized electronic parts for use in the electronic industries, which ensures that the stored parts will be positively and stably aligned in the casing without the possibility of any play or disorientation from their regular positioning within the casing. The casing is provided with a single piece resilient element which is inserted into the casing, the resilient element being designed to resiliently expand against the inner wall surface of the casing to frictionally engage therewith. Thereafter, a plurality of parts are inserted one after another into the casing so that they become stacked in a serially aligned manner inside the casing against the resilient force of the resilient element, thus preparing a casing loaded with a plurality of parts therein stacked in a serially end-to-end resting state. If desired, another resilient element may be inserted into the casing onto the lastly fed part so that the parts stored within the casing may be positively held in their original position.

10 Claims, 9 Drawing Figures

METHOD AND APPARATUS FOR PREPARING A CASING LOADED WITH A PLURALITY OF ARTICLES

The present invention relates in general to a method of and an apparatus for preparing a casing loaded with a plurality of objects in an aligned manner, and more particularly to a method of and an apparatus for positioning a plurality of small sized objects such as electronic parts having no lead wires such as a chip capacitor or a chip resistor in a controlled serially stacking manner in a casing or a cartridge, each of the parts being of the same type, for sequentially transferring such electronic parts into a predetermined position at a work station of the manufacturing or assembly line of such parts for use in a variety of electronic systems.

The development of the electronics industry has created an increasing demand for improved manufacturing processes which lend themselves to automating the mounting or installing procedures of small sized electronic parts at a predetermined position in an electronic element or circuit as part of an electronic circuit manufacturing process. The mounting or installing of such small sized electronic parts in desired positions in an automated manufacturing or assembly line is generally realized in the prior art by having parts of a single type aligned or stacked in a casing or in a straight-lined groove or hollow tube for storing parts therein. This storing of electronic parts also has utility, thanks to its ease in handling, not only in the manufacturing or assembly operation, but also in the stocking and/or transportation of electronic parts. One prior art apparatus for aligning or stacking electronic parts employs a conventional parts feeder or the like which is operated with electro-magnetic vibration system. In such an arrangement, however, difficulties were experienced in that the electronic parts could only be aligned or stacked as desired in one orientation but not well controlled in any other ways due to their directivity in positioning. Such problem is unavoidable as long as such electronic parts are designed with a variety of symmetrical configurations peculiar thereto. For example, if an electronic part has a circular shape as shown in FIG. 1A, or a rectangular shape as shown in FIG. 1B, it is feasible to have a plurality of parts aligned or stacked in a good position as desired in their longitudinal directions or with their longer sides set flat and their shorter sides adjacent each other in a casing 1, as typically shown in FIG. 2A. However, electronic parts having the geometrical shaping illustrated in FIGS. 1A and 1B could hardly be aligned or stacked well with their longer sides adjacent with each other as shown in FIG. 2B because some of the electronic parts are likely to take an undesirable irregular position or orientation in a casing, as shown in FIG. 2C. The parts would depart from their regular alignment since some of them would inevitably stand up or lean in a wrong way inside the casing during a feeding procedure or would become misaligned during improper handling after the loading.

In the case of electronic parts such as a chip capacitor or a chip resistor having electrode surfaces on their end sides in the longitudinal direction, alignment in the manner shown in FIG. 2A becomes disadvantageously because the orientation of each of the electronic parts 2 must be individually charged while feeding from the casing 1 onto a base element such as a substrate in the assembly step. Consequently, when electronic parts 2*a* or 2*b* (these designation being confined to FIGS. 1A and 1B; in FIGS. 2 to 6 the electronic parts are designated by single numeral "2") are aligned as shown in FIGS. 1A and 2A, it is inevitably necessary to relocate the parts to another orientation suitable for a subsequent step of the assembly line before installing the part onto a substrate of a printed circuit or the like. This disadvantageously requires means for performing a relocation operation on an automated assembly machine which obviously adds to its complexity.

In consideration of the disadvantages experienced in the prior art as stated above, it would be advantageous if an improved and useful method and apparatus were provided to overcome the problems which have been left unsolved in the prior art. This invention is essentially directed to meet these requirements which have thus far been left unfulfilled.

It is therefore a primary object of this invention to provide an improved method and apparatus for automatically stacking and positively holding a plurality of electronic parts in a regularly aligned end-to-end state in a casing member.

Another object of this invention is to provide an improved means of controlling or restricting an irregular alignment of the electronic parts stored in a casing member.

It is a further object of the invention to provide a simple, economical, yet reliable method and apparatus for use in an assembly line for facilitating the assembly of electronic parts.

According to the present invention, briefly summarized by way of a preferred embodiment thereof, there is provided an improved method of preparing a casing loaded with a plurality of objects stacked and positively stored in a serially aligned state therein, which comprises the steps of (1) inserting a resilient means for frictionally conditioning or restricting the positioning of the plurality of objects from a top opening to a location adjacent thereto in a hollow space of the casing means, (2) as a preliminary matter having the plurality of objects in a serial and stably aligned state in a magazine or channel means to allow handling ease in subsequent assembly steps, (3) aligning the top opening of the casing means in operative relationship with respect to leading one of the plurality of objects preliminarily aligned in the magazine or channel means, (4) sequentially sending the plurality of objects out of the magazine or channel means toward the top opening of the casing means, and (5) thereafter forcing sequentially the aligned plurality of objects to be fed one by one into the top opening of the casing means and onto the resilient means to frictionally rest in the hollow space of the casing means against the resilient force of the resilient means to be held therein, whereby the plurality of objects are positioned one after another and positively and stably held in the hollow space of the casing means in a serially aligned and stacked state.

The foregoing objects, characteristics, principle, and details of the present invention, as well as further objects and advantages thereof, will become more apparent from the following detailed description of a preferred embodiment of the invention when read in conjunction with the accompanying drawings, in which like parts are designated with like reference numerals.

In the drawings;

FIGS. 1A and 1B are perspective views of electronic parts aligned serially side-by-side;

FIGS. 2A, 2B, and 2C are longitudinal cross-sectional views showing a casing having electronic parts stored therein;

The method and apparatus for loading or stacking a plurality of electronic parts and positively effectively holding the same in a casing in a serially aligned state according to this invention will now be described in detail with respect to a preferred embodiment thereof in conjunction with the drawings, particularly FIGS. 3 to 6. It should be understood, however, that the embodiment described herein is for illustration purposes only, and is not in any way limiting of the scope and spirit of the invention.

Figure 3:
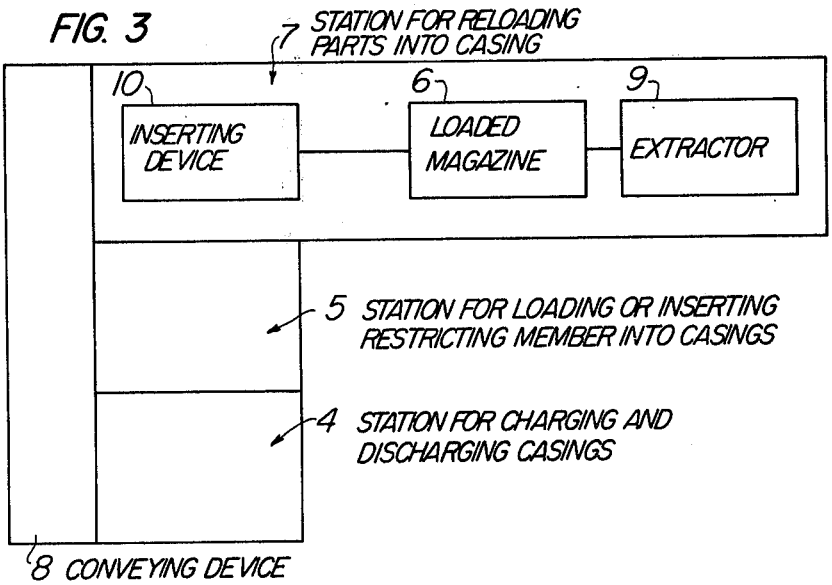
FIG. 3 is a schematic block diagram showing a parts stacking and feeding apparatus line according to this invention.

Referring first to FIG. 3, there is shown a schematic block diagram of an apparatus for practicing an improved method according to this invention by way of a preferred embodiment thereof.

The apparatus for stacking and positively holding a plurality of electronic parts in a serially aligned state in a casing according to this invention generally comprises a station 4 for charging and discharging a plurality of casings capable of storing a plurality of electronic parts 2 therein, a station 5 for loading or inserting a member for conditioning or restricting the insertion of individual electronic parts inside the casing, a station 7 for reloading a plurality of electronic parts from a loaded magazine 6 which contains a plurality of parts preliminary aligned therein, and a conveying device 8 adapted to transport each casing to each of the above mentioned stations and position each casing. The station 7 stated above further comprises an extractor 9 adapted to discharge or feed the electronic parts aligned in the magazine 6 progressively outwardly and an inserting device 10 adapted to forcibly insert the electronic parts into the casing.

Now referring to the accompanying drawings, a description will now be given for station 7 adapted to reload the electronic parts into the casing, and the station 5 adapted to feed the members for conditioning the positioning of the parts 2 in a desired orientation inside the casing, which are main components of the apparatus according to this invention.

Figure 4:
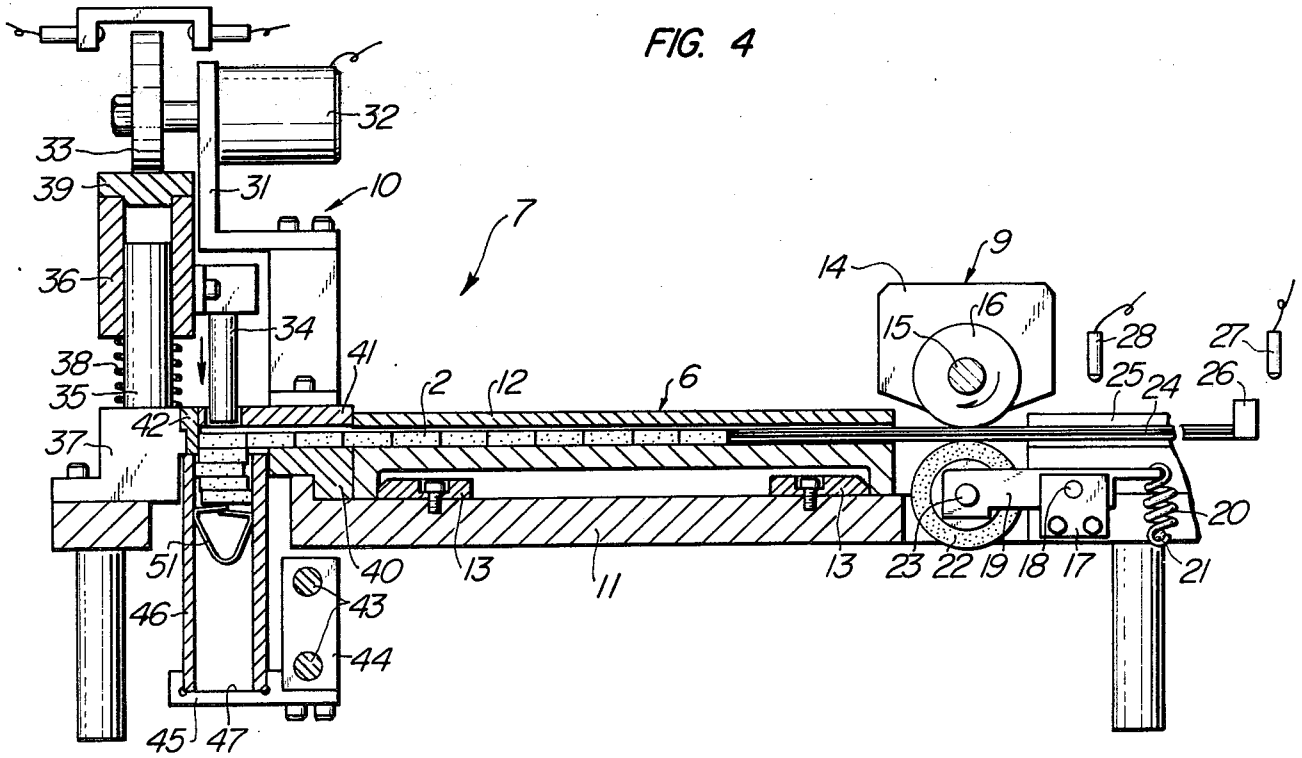
FIG. 4 is a front elevational view, in vertical section, showing a loading station of the apparatus of this invention.

Referring to FIG. 4, the extractor 9 is provided with fixing members or positioning zigs 13 adapted to fix the positioning of a magazine 12 which is securely mounted on a base 11 of a machine, and a driving motor 14 which is operable in either a forward or rearward direction. A driving roller 16 is provided on an output shaft 15 of the driving motor 14. On the base 11, there is fixedly mounted a bracket 17 for pivotally holding a lever 19 about a pin 18 which is fix and extends from the bracket 17. A tension coiled spring 20 is also provided hooked to one end of the lever 19 and at the other end to a spring pin 21. At the other extremity of the lever 19, there is provided an idler roller 22 rotate about a rotating shaft 23. Between the driving roller 16 and the idler roller 22 there is arranged in a pinched relationship an extracting rod 24 adapted to forcibly extract the electronic parts sequentially outwardly from the magazine 12. A guide groove 25 is fixedly mounted on the base 11 so that the extracting rod 24 can slidably move along the guide groove 25. At the rear end of the extracting rod, there is fixed a plate member 26, and photosensitive elements 27, 28 are arranged at the both extensions of the guide groove 25.

The inserting device 10 for feeding the electronic parts 2 comprises a driving motor 32 fixed mounted on the bracket 31 and a circular or disc shaped cam 33 secured on the output shaft of the driving motor 32. The disc shaped cam 33 is eccentrically mounted so that a stroke of linear motion is provided in its diametral direction to a member which contacts the outer circumference thereof. In a position immediately under the disc cam 33, there is provided a feeding rod 34 fixed on a reciprocating block 36 which is slidably held along a guide rod 35, the guide rod 35 being securely mounted on a bracket 37 mounted on the base 11. Between the bracket 37 and the reciprocating block 36 is mounted a compression coiled spring 38 extending around the guide rod 35. At the top of the reciprocating block 36, there is fixedly mounted a head piece 39 which bears against the disc cam 33. The compression spring 38 is adapted to constantly force the head piece 39 into contact with the disc cam 33.

A rail 40 is fixedly mounted on the base 11 in such a manner that the level of the rail 40 may be as high as that of the sliding surface of the plurality of electronic parts aligned in the magazine 12. A rail cover 41 is provided immediately above the rail 40, the rail cover 41 having a through hole adapted to let the feeding rod 34 pass therethrough. Also, a stopper 42 is provided on the bracket 37 against a side surface thereof facing the end of the rail 40.

In the construction of the apparatus according to this invention, there is arranged an effective means for positioning the casing 46 to be stocked in the apparatus. The positioning means comprises a positioning block 44 adapted to slidably move along guide rods 43 under the base 11, and a casing carrier tray 45 fixed mounted against the positioning block 44. In addition, means are further provided for effecting the positioning of the block 44 at proper positions relative to the stations 4, 5 and 7, which means are a detent means of generally known construction having notches, balls and coil springs operatively connected together. The casing carrier tray 45 is designed with a channel or groove 47 adapted to hold the casing 46 in position thereon.

Figure 5:
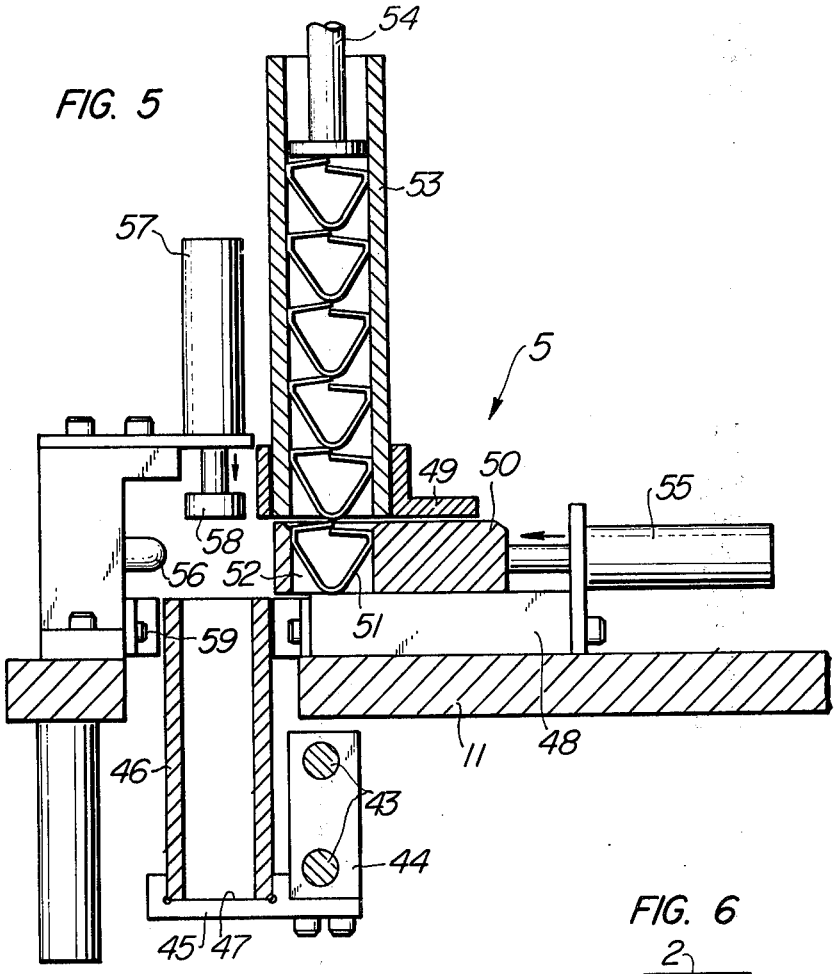
FIG. 5 is an elevational view, in vertical section, showing a feed station for serially feeding parts into a conditioning means of the apparatus according to this invention.
Figure 6:
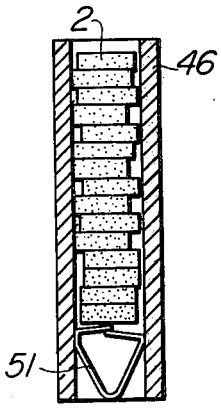
FIG. 6 is a longitudinal cross-sectional view of a casing according to this invention showing the loading or stacking of electronic parts therein.

Now, referring to FIG. 5, there is shown the station 5 for loading a member 51 adapted to condition or hold the positioning of the plurality of electronic parts to be fed into the casing. This station comprises a plate 48 and a fixing block 49 rigidly mounted on the base 11, and, in addition, a carrier 50 which is adapted to slidably move in contact relationship between the upper surface of the plate 48 and the lower surface of the fixing block 49. The carrier 50 is formed with a space 52 to receive a member 51 for conditioning or holding the positioning of the plurality of electronic parts 2 while they are loaded into the casing 46. The fixing block 49 is provided with a stocker 53 which is designed to stock the restricting members 51 therein in a serial relationship, and also with a push rod 54 at the top of the stocker 53. The carrier 50 is connected to an actuator 55 as shown, and in the forward extension of the stroke motion of the actuator 55, there is provided a contact or stop peg 56 so that the stop peg may contact the forward end of the carrier 50 when it reaches the end of the stroke motion of the actuator or carrier. An actuator cylinder 57 for feeding the restricting members 51 to the casing 46 is arranged above the stop peg 56; that is, right above a position occupied by a single restricting member 51 after being fed by the carrier 50 which abut the stop peg 56. At the leading end of a rod of the cylinder 57 there is provided a means 58 for directing and detecting the insertion of a restricting member 51 into a desired position within a casing. Under the stop peg 56, there is securely mounted a guide plate 59 adjacent the base 11. The restricting member 51 may be of a slip like shape made of resilient rod material, e.g., metal or plastic resin, formed in a generally triangular shape. The configuration and material of the restricting member 51 may be anything other than those mentioned above only if it can effect a restricing force against the inner wall surface of the casing when inserted therein.

As viewed in FIG. 5, the guide rods 43 extend under the station 5 in the same manner as for the station 7, so that the positioning block 44 can slidingly move along the guide rods 43 in a proper position under the station 5 and located the casing 46 in a position immediately below the directing and detecting means 58 to receive one restricting member 51 therein at a time.

The operation of the apparatus according to this invention will now be described. When an automatic feeding of the plurality of electronic parts 2 into the casing 46 is effected by the described alignment feed mechanism, the following procedures are performed. First, the casing 46 is positioned at the station 5 for a loading therein of the restricting member 51, and then a single piece restricting member is fed from the stocker 53 into the space 52 of the carrier 50 by function of the push rod 54, thereafter the restricting member 51 is pushed in lateral travel toward a position where the leading end of the carrier 50 reaches or contacts the stop peg 56. The single piece restricting member 51 is captured resiliently and frictionally inside the hollow space 52 of the carrier 50 during this stroke of motion. At this moment, the restricting member 51 held in the carrier 50 is located right under the actuator cylinder 57, and right above the casing 46 held in position. Then, the actuator cylinder 57 comes downwardly toward the restricting member 51 in the carrier 50 so as to force the restricting member further downwardly from the carrier 50 level into the hollow space of the casing 46. As soon as this inserting cycle is completed, there is emitted an electric signal indicating the completion of the inserting mode from the directing and detecting means 58 installed at the leading end of the actuator cylinder rod. At this moment, the restricting member 51 is completely inserted near the top opening of the casing 46.

In the next step, the casing 46 now loaded with a single piece of the restricting member 51 therein is shifted transversely by the positioning block 44 along the guide rods 43 toward the station 7, and located in a proper position under the station 7. Now, the magazine 12 holding the plurality of electronic parts 2 in a serially aligned state therein is held in a proper level and position with respect to the rail 40 and hence the casing 46 resting in a desired position due to the adjustment of the fixing members or positioning zigs 13 is ready for a feeding therein of the plurality of electronic parts 2. After a check for a proper positioning of the magazine 12 is made, the driving roller 16 is driven in rotation by the motor 14. By the driving motion of the roller 16, the extracting rod 24 is now caused to be pushed between the driving roller 16 and the idler roller 22 so as to be urged forwardly along the guide groove 25. With this stroke of sliding motion of the extracting rod 24, the serially aligned array of electronic parts 2 is as a unit pushed forwardly until the leading one of the parts successively bear against the stopper 42 on the side wall of the bracket 37. After passage of a short period of time, when driving the motor 32 on the bracket 31 is driven and the circular or disc shaped cam 33 is driven in rotation. As mentioned hereinbefore, the disc cam 33 is provided with an eccentric shape, i.e., is offset from its center, and the head piece 39 of the reciprocating block 36 and the feeding rod 34 are in operative connection therewith. As a result, a linear motion of the feeding rod 34 occurs by a stroke corresponding to the distance of offset of the disc cam 33, thus causing the feeding rod 34 to move downwardly toward the leading electronic part of those serially aligned inside the magazine 12. The leading electronic part is then pushed downwardly into the casing 46 properly positioned under station 7. The above mentioned stroke of downward motion of the feeding rod 34 is selected to be substantially equal to a thickness of the electronic parts 2. The force effected by the downward motion of the feeding rod 34 stated above provides a pushing or inserting effect for the leading electronic part together with the previously inserted restricting member 51 into the casing 46 by a distance corresponding to the thickness of the electronic part 2. As the reciprocating block 36 is adjusted to move downwardly with a first half rotation of the disc cam 33, and move upwardly with a second half of rotation of the disc cam 33, and also the extracting rod 34 is cooperative to push or feed the electronic parts 2 forwardly during an intermission between such downward and upward motions of the feeding rod 34, the aligned array of electronic parts 2 can now be fed forwardly and intermittently as the reciprocating block 36 returns upwardly. As a consequence, there occurs a serial or intermittent feeding operation of the electronic parts 2, whereby the electronic parts 2 can be fed one after another out of the magazine 12 into the casing 46 at an interval during which the operating motors 32 and 14 are kept driving, and this feeding operation continues until the predetermined number of electronic parts 2 is stacked in a serially aligned manner in the casing 46, thus completing the stacking of electronic parts 2. When a predetermined number of electronic parts 2 is discharged out of the magazine 12, there is emitted an electric signal indicating the completion of a feeding cycle. This signal caused by the cooperation of the photosensitive element 28 with the plate member 26, thus causing the driving motor 32 to be stopped and simultaneously causing the motor 14 to be reversed in rotation so as to bring the extracting rod 24 backwardly, thus completing the loading procedure of the casing 46. As a next step, the loaded casing 46 is set back to the station 5, where the casing has another restricting member 51 inserted therein, thereafter the casing 46 is carried to the charging and discharging station 4 where the thus loaded casing 46 is removed. With the loading operations effected by the apparatus according to this invention, a casing 46 is obtained having a predetermined number of electronic parts 2 stored therein in a serially aligned stacking stage together with the restricting members 51.

As fully described hereinbefore, according to this invention, there is provided an improved and useful method and apparatus for loading a plurality of electronic parts into a casing in a manner which facilitates later manufacturing or assembly procedures using the electronic parts.

Figure 1A:
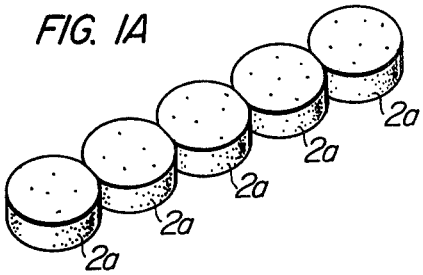
Figure 1B:
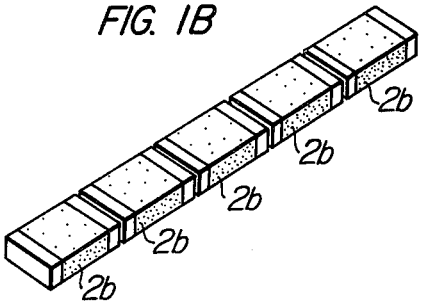
Figure 2A:
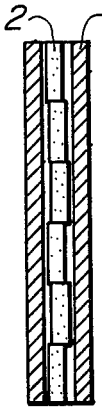
Figure 2B:
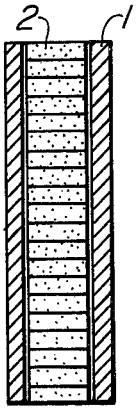
Figure 2C:
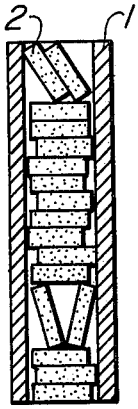

The present invention achieves the following advantageous features and effects made possible by the preparation of a casing loaded with electronic parts:

(1) By first loading a restricting member of a clip-like shape having resiliency into a casing and then serially stacking a plurality of electronic parts in an aligned manner into the casing against the restricting member by forcing downwardly the electronic parts one by one against the resilient expansive force of the restricting member, the array of stacked electronic parts is always in a serially aligned state in the casing and the parts are never out of their regular positioning, as typically shown in FIG. 2C.

(2) By snapping in two restricting members one before and one after the insertion of the plurality of electronic parts in a serially aligned manner into a casing by using the same station in the line of preparation of the casing, problems occuring due to irregular play in the stacked electronic parts in the casing after the completion of such preparation work is avoided.

(3) By using a magazine wherein a plurality of electronic parts are preliminarily aligned to facilitate their proper positioning in a casing, and causing the plurality of electronic parts to be fed one by one by being pushed from the last of the array of parts, the array of electronic parts may readily be fed smoothly and within a relatively short time, and thus any trouble due to improper feed could effectively be prevented.

In addition, according to the present invention, there is a further advantage made available by way of preparing a plurality of casings, each casing having a plurality of electronic parts stored in a plurality of rows thereof, in that the apparatus may be made of small dimensions, while handling a larger number of electronic parts at a time. Thus, the preparation procedures can be performed within a shorter period of time per one unit of electronic part.

Although detailed descriptions have been made with reference to a typical embodiment of this invention, it should be understood, as indicated hereinbefore, that the described preferred embodiment is not to be taken in any way as a limitation of this invention. On the contrary, many changes, variations, and modifications with respect to the construction and arrangement in the practice of the invention may further be derived by those skilled in the art to which the present invention pertains, whereby the advantageous characteristics of this invention may be realized without departing from the spirit and scope of the invention which set forth in the appended claims.

What is claimed is:

1. In a method of preparing a casing means loaded with a plurality of objects stacked in a serially aligned position therein, said objects having a geometrical shape which tends to occasionally change their orientation when left in a free condition within said casing means, the improvement which comprises the steps of: serially aligning end-to-end said plurality of objects in a magazine, aligning a top opening of said casing with a means storing a plurality of resilient means, inserting a first resilient means from said storing means within said casing means for frictionally engaging with the interior wall thereof to restrict the movement of said plurality of objects subsequently inserted from said top opening to a location adjacent thereto in a hollow space of said casing means, aligning said top opening of said casing means in operative relationship with respect to a leading one of said serially aligned plurality of objects in said magazine, sequentially feeding said plurality of objects out of said magazine towards said top opening of said casing means, and sequentially forcing said aligned plurality of objects one after another into said top opening of said casing means and onto said first resilient means to thereby sequentially force said first resilient means further into said casing means with the entrance of each object into said casing means whereby said plurality of objects are positioned one after another in said hollow space of said casing means in a serially aligned and stacked manner.

2. The improvement as claimed in claim 1, wherein said steps of feeding said plurality of objects out of said magazine and forcing the fed objects into said casing means are operatively synchronized with each other in such a manner that at the moment said feeding step is completed, said forcing step takes place, said feeding and forcing steps being continued intermittently one after another.

3. The improvement as claimed in claim 1, wherein said forcing step is performed in a manner which positively excludes any substantial gap from existing between said plurality of objects fed into said hollow space of said casing means.

4. The improvement as claimed in claim 1 which further comprises the steps of realigning said casing with said storing means and inserting a second resilient means into said casing means onto a lastly fed one of said plurality of objects after a predetermined number of said objects have been fed into said hollow space of said casing means, said first and second resilient means cooperating to positively hold said plurality of objects in their positions as a unit inside said casing means.

5. In an apparatus for preparing a casing means having a hollow space therein loaded with a plurality of objects stacked in serially aligned position, said objects having a geometrical shape which tends to occasionally change their orientation when left in a free condition within said casing means, the improvement which comprises first means storing a plurality of objects in a serially lengthwise aligned manner, second means storing a plurality of independent resilient means each capable of frictionally engaging with the interior of said casing means, means cooperating with said second means for inserting a stored resilient means into said hollow space of said casing, means cooperating with said first means for sequentially feeding said plurality of serially lengthwise aligned objects into alignment with the hollow space of said casing, means for sequentially forcing a leading one of said plurality of objects one at a time into said hollow space of said casing, and a casing locating means for moving said casing to a first position where it receives a said resilient means from said means for inserting and for thereafter moving said casing means to a second position where it sequentially receives said plurality of objects from said means for sequentially forcing said objects one at a time into said casing, whereby a casing means may be attained having a plurality of objects stacked therein on said resilient means.

6. The improvement as claimed in claim 5, wherein said plurality of objects are preliminarily held in a serially aligned state in a magazine adapted to store said plurality of objects therein.

7. The improvement as claimed in claim 6, wherein said resilient means are operative to resiliently expand against an inner wall surface of said casing means to frictionally restrict the insertion of said plurality of objects into said casing means.

8. The improvement as claimed in claim 6, wherein said casing means comprises a tube having no end wall but having a through hole therein.

9. The improvement as claimed in claim 6, where each of said resilient means is an element made of a metal having resiliency so as to be snapped into said hollow space of said casing means.

10. The improvement as claimed in claim 6, wherein each of said resilient means is an element made of a plastic resin having resiliency so as to be snapped into said hollow space of said casing means.

* * * * *